United States Patent [19]

Edwards et al.

[11] 4,119,233

[45] Oct. 10, 1978

[54] CLOSURE CAPS

[75] Inventors: Cyril Kenneth Edwards, Oadby; Edward Harry Webb, Rugby, both of England

[73] Assignee: Thomas Hunter Limited, Rugby, England

[21] Appl. No.: 768,767

[22] Filed: Feb. 15, 1977

[30] Foreign Application Priority Data

Feb. 18, 1976 [GB] United Kingdom ..... 6444/76

[51] Int. Cl.[2] ..... B65D 41/04

[52] U.S. Cl. ..... 215/337; 215/340; 215/354

[58] Field of Search ..... 215/329, 333, 337, 339, 215/340, 341, 354

[56] References Cited

U.S. PATENT DOCUMENTS

| | | | |
|---|---|---|---|
| 824,896 | 7/1906 | Willis | 215/337 |
| 1,481,961 | 1/1924 | Hammer | 215/333 |
| 1,972,280 | 9/1934 | Von Till | 215/333 |
| 2,404,410 | 7/1946 | Smith | 215/337 |
| 3,516,565 | 6/1970 | Hatkevich | 215/333 |

*Primary Examiner*—Donald F. Norton

*Attorney, Agent, or Firm*—Parmelee, Miller, Welsh & Kratz

[57] ABSTRACT

In convention lug caps or pre-threaded caps to be screwed onto a threaded neck ring of a bottle or jar, it sometimes happens that the lugs or threads become hooked under the threads during application of the cap. This can lead to damage to the lugs or threads and failure of the closure. According to the invention, a lug cap or pre-threaded cap is provided with a formation such as a wall to prevent the cap being applied to the neck of the bottle when such hooking is threatened.

A combination of a bottle or jar having a neck with external threads or lugs and a closure cap having a top and depending skirt with further threads or lugs for engagement with the neck and a formation extending from the top which defines a gap between the end of the threads or lugs on the skirt and the formation such that the formation will enter the neck by pivoting movement when the skirt threads or lugs are above the threads on the neck but prevent such pivoting when there is firm hooking of th skirt threads or lugs beneath the threads on the neck.

12 Claims, 13 Drawing Figures

PRIOR ART

CLOSURE CAPS

This invention relates to closure caps and more particularly to closure caps of the type which have tops with depending skirts provided with preformed lugs or internal threads for engagement with external threads on bottles, jars or the like to be closed. Such caps are known as lug caps or pre-threaded caps respectively and will be collectively referred to herein as caps of the type described. The term "bottle" is used in the following description of the present invention will be used to include bottles, jars and like open-topped containers, while the term "thread" as used herein will be used to include a thread or series of threads, and the term "lug" as used herein will be used to include a lug or series of lugs.

In practice, it is customary when applying caps of the type described, successive bottles are gripped and fed through a machine to which the closure caps are supplied along a track or chute running at a shallow angle downwardly towards the path of the tops of the bottles, which tops are provided with neck rings having external threads for engagement by the threads on the closure cap skirts. Each bottle picks up one closure cap from the track or chute. Top pressure is applied and the closure cap is screwed down, in the case of a lug cap usually in two stages, namely a preliminary rotation to engage the lugs or threads on the skirt with the external threads on the neck ring and a rotation under pressure to tighten the closure cap in engagement with the threads.

During the initial engagement of the closure cap on the top of the bottle, the leading parts of the top engage inside the forward part of the skirt of the closure cap (and particularly with a lug or thread in the forward part) to entrain the closure cap in the motion of the bottle, and the remainder of the skirt of the closure cap then drops over the top of the bottle. It will be appreciated that the bottles and the closure caps have random relative orientations during this initial engagement stage, so that the relative positions of the lugs or threads on the skirt and the external threads on the neck ring may vary over a wide range.

When the lug or thread first engaged by the top of the bottle is wholly above the thread on the neck ring, there is no problem and the closure cap can fall freely over the top of the bottle, and the application of top pressure ensures that the closure cap is held down level.

The invention will be described with reference to the FIGS. 1–13 of the accompanying drawings.

FIG. 1, 2 and 3 describe the prior art;

Figure 1:
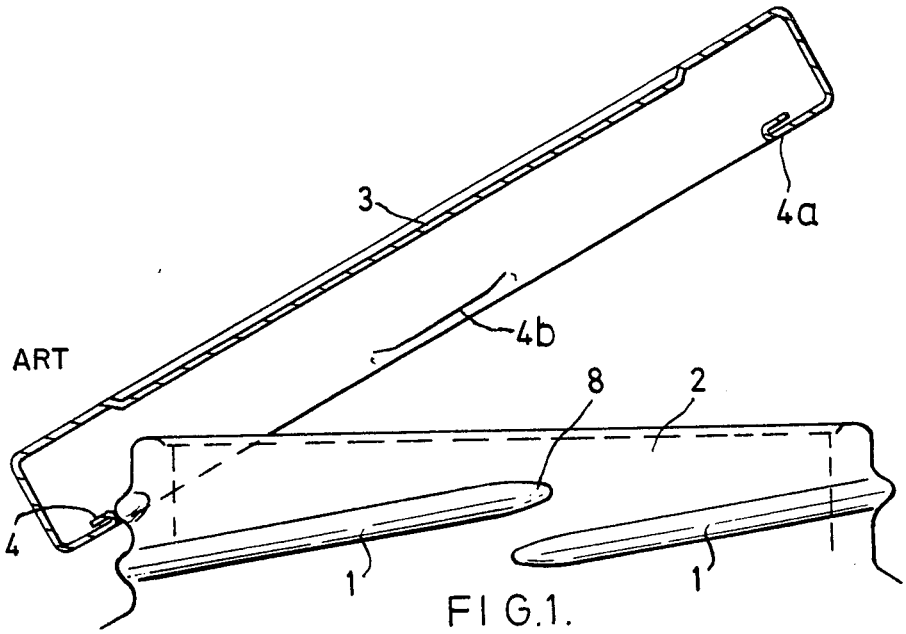
FIG.1. PRIOR ART
Figure 2:
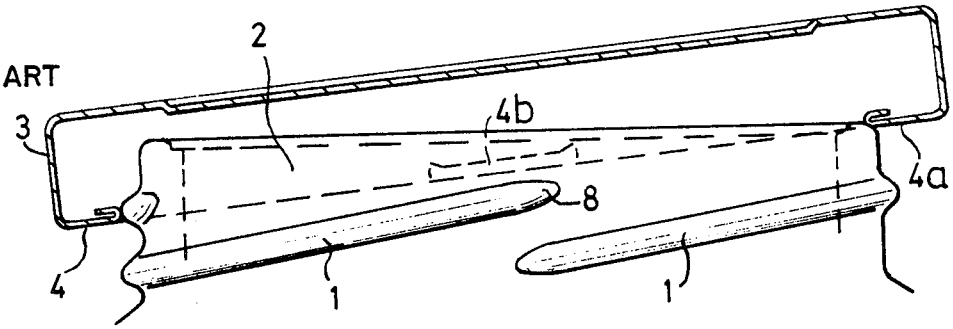
FIG.2. PRIOR ART
Figure 3:
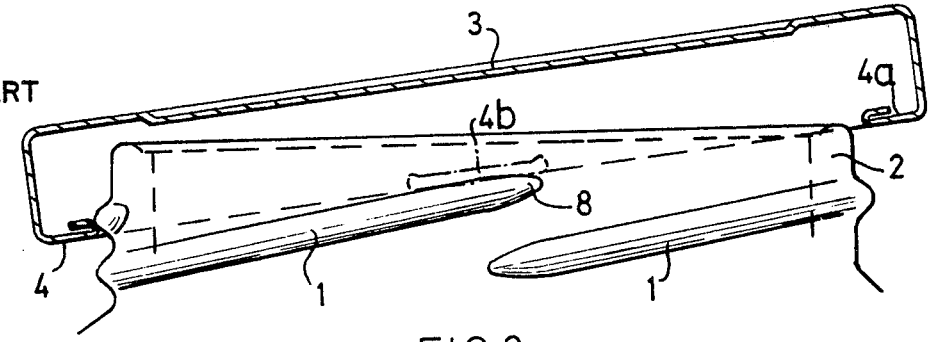

Reference shall now be made to FIGS. 1, 2 and 3 of the drawings accompanying this specification, which figures are diagrammatic elevations of the neck ring of a typical bottle with sectional views of a typical conventional lug cap coming into engagement therewith.

In these drawings, the neck ring 2 has a four start thread 1 and the cap 3 has correspondingly four lugs 4 at 90° spacing. This is a common case occurring in practice, but it will be understood that the invention is not limited to four-start threads or caps with four lugs.

FIG. 1 shows a first engagement position with the leading lug below the thread.

When one or more lugs first engaged by the top of the bottle is engaged only slightly below the apex of the thread, the top pressure in conjunction with the motion of the bottle will cause such lug to be pulled over the apex of the thread to the correct position above the thread, with possible slight but acceptable damage to the tip of the lug. There may also be, in this condition, some slight damage caused by engagement of the opposed lugs with the top of the bottle but again this will usually be insufficient to render the lugs ineffective in engaging the thread on the subsequent turning and is unlikely to affect the seal obtained, and as such should be acceptable.

A further example of self-correcting engagement occurs when the lug is hooked below the nose portion 8 of the thread. In this case the pulling over may be augmented by reverse rotation of the cap due to the camming action on the inclined flanks of the nose portion 8 of the thread. This self-correcting feature diminishes when any part of the lug is engaged beneath the full form of the thread and consequently firm engagement can occur. In practice, when the whole of the top of the lug is engaged beneath the full form of the thread, the self-correcting action becomes inoperative.

FIGS. 2 and 3 illustrate typical conditions where a lug is firmly engaged or hooked below one or more threads on first contact with the neck ring 2 on the top of the bottle. In these figures the leading lug 4 has not pulled over the thread. In FIG. 2, there is illustrated a cap in which a lug indicated at **4*a* at the trailing edge of the cap engages firmly with the top of the neck ring 2** of the bottle and will subsequently be crushed by the top pressure. Such damage normally renders the securing of the closure cap ineffective to provide a proper seal, so the closure is a failure. This form of hooking is frequently firm and not self-correcting.

The cap with a crushed lug may in fact seal on the container by means of the internal vacuum, but this seal will not be reinforced by the mechanical engagement of the lug and thread, and consequently it may fail later.

Another form of firm or non-self-correcting engagement or hooking is shown in FIG. 3, wherein the relative orientation of the neck ring and cap are slightly different from those shown in FIG. 2, so that the lug **4*a* at the trailing edge clears the edge of the neck ring 2 but the intermediate lugs indicated at 4*b* then engage firmly on the upper sides of the thread. The lug 4*b* illustrated is that on the nearer side of the cap which engages the illustrated thread. The lug 4*b*** on the further side of the cap will engage a thread which is sloped in the opposite direction relative thereto. The top pressure causes crushing of these two lugs and again the closure will be liable to failure.

It will be appreciated that similar forms of hooking or engagement may occur with skirts having pre-forming threads.

It is an object of the present invention to prevent the occurrence of such firm engagement or hooking, so as substantially to eliminate closure failures from this cause.

Accordingly, the present invention consists in a combination of a bottle having a neck ring with external threads, and a closure cap of the type described, of which the top is provided, inwardly of the area engaged or engageable with the upper surface of the neck ring of the bottle, with a formation, or pattern of formations, extending from the top in the same direction of the skirt to a position where the gap between the end of each lug or thread on the skirt and the nearest point of the formation or pattern of formations is insufficient to allow the formation or pattern of formations to enter the neck ring whilst any of the lugs or threads on the skirt are firmly engaged beneath an external thread on the neck ring.

The gap will be acceptable if it is less than the minimum distance between the underside of the root of the thread and the inner corner of the face of the neck ring. The formation may be a circular wall extending parallel with the skirt. Within the wall, the cap top may revert to the level of the skirt top. This is conducive to good stackability.

In addition to its primary function of preventing hooking of the lugs or threads on the skirt below the thread on the neck ring, the wall may have the effect of shearing overhanging lengths of shreaded material, such as coleslaw, which may be packed in the bottle. This may also reduce failure due to the material which might otherwise be trapped beneath the seal.

The wall may be provided with a sealing surface, to which a sealing medium may be applied for engagement with the inside of the rim of the neck ring of the bottle. This seal may be alternative or additional to the conventional sealing against the top of the neck ring.

Also, the presence of such a wall increases the rigidity of the closure cap, which is very important in that it enables thinner material to be used to form the closure cap.

As an alternative to a pressed-in wall, the formation, or pattern of formations may be provided by a suitable insert, either pre-formed or flowed-in.

It will be appreciated that the invention is applicable to closure caps made in a wide variety of materials, particularly aluminium and tinplate.

The invention further consists in a closure cap of the type described having a wall extending from the top and arranged to enter inside the neck ring of the bottle to be closed when the cap is screwed down.

Such a wall will define a gap with the edges of the lugs and for various types of bottle, the gap will have a maximum size to avoid hooking. For example with a standard 53 or 58 mm diameter neck ring jar, the gap should be less than 8.3 mm, for a 63, 66, 70 or 71 mm neck ring, less than 8.0 mm, and for a 82 mm diameter neck ring it should be less than 9.1 mm. The standard sizes of neck ring are typical of those used in the United Kingdom and it will be appreciated that with standard sizes of neck rings used in other countries different maxima may apply.

Figure 4:
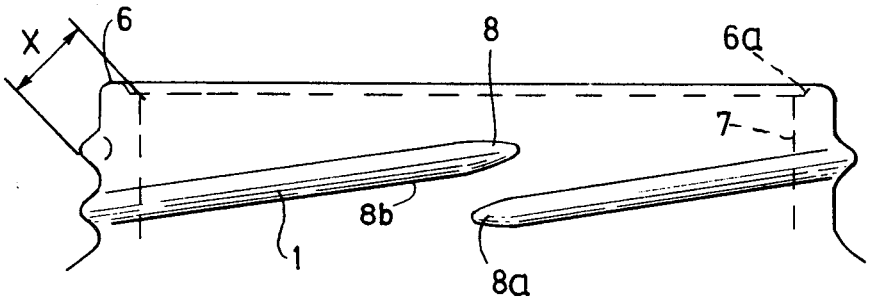
FIG. 4 illustrates in elevation a typical neck ring of a bottle.

FIG. 4 shows a typical neck ring for a glass bottle the neck ring having an external four start thread 1 and an upper surface of rim 6 for engagement with sealing compound carried in the top of a lug. The upper surface of the neck ring is shown as being recessed slightly below the surface, as illustrated at *6a* in the drawings, although it need not necessarily be so recessed. The internal surface of the neck ring is indicated at 7. The thread 1 is formed with leading noses 8 and trailing noses 8*a*. A dimension "X" has been indicated to illustrate the minimum distance between the underside of the root 86 of the thread where the nose portion 8, FIG. 4, of the thread develops into the full thread form and the inner corner of the upper surface of the neck ring. It will be appreciated that as the angular position varies so does the position of the thread in relation to the top of the neck ring.

Figure 5:
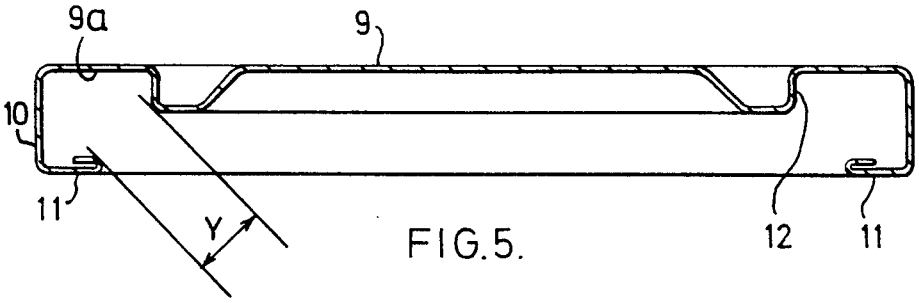
FIG. 5 is a sectional view of a preferred form of closure cap according to the present invention for use on a neck ring as illustrated in FIG. 4.

FIG. 5 shows a diagrammatic sectional view of a lug cap constituting one preferred form of the present invention. The illustrated lug cap has a top 9, a depending skirt 10 and four lugs 11 for engagement with the four starts of the thread shown on the neck ring in FIG. 4. An annular cavity 9*a* within the top 9 near the upper side of the skirt 10 will be partially filled with a sealing compound to engage sealingly with the upper surface 6 of the neck ring. In addition to these conventional features, the lug cap shown in FIG. 5 has in addition a depending annular wall 12 coaxial with the skirt 10 and substantially parallel therewith and extending sufficiently far towards the level of the lugs 11 that the dimension, illustrated at Y, which is the gap between the bottom of the wall 12 and the inner ends of the lugs 11 is not greater than the dimension X illustrated in FIG. 4. The effect of this will be described in more detail with reference to FIGS. 6, 7 and 8, but it will fairly readily be seen that this in fact prevents the wall from entering within the neck ring while any of the lugs 11 are hooked beneath the thread 1. Inside the wall 12, the level of the top 9 of the cap is illustrated as returning to substantially its original level so that the bottles with these caps on them may be stacked. Experience has shown that good stackability over a considerable variety of jars has been achieved by a compromise on the amount to which the cap top is reverted back towards being level with the skirt top. It has been found that the level of the top of the cap may vary from the level of the skirt top down to .04 inches below the top of the skirt.

It will be appreciated that caps as illustrated in FIG. 5 are intended for use similarly to conventional lug caps, and in fact will operate very similarly thereto in circumstances where the initial engagement is with the lugs 11 wholly above the thread 1, or below the noses 8 so that the position of the cap corrects itself to the required position where the lugs 11 are resting on threads 1 so as to engage properly beneath the succeeding thread on twisting of the cap relative to the neck ring.

Figure 6:
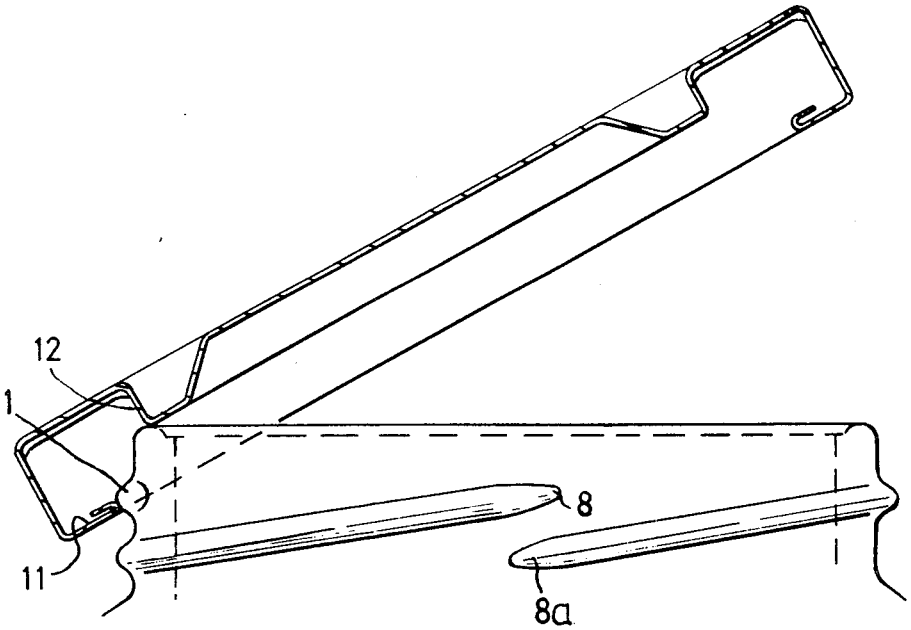
FIGS. 6 to 8 illustrate how the cap of FIG. 5 avoids firm engagement of the lugs beneath the threads of the neck ring of FIG. 4.
Figure 7:
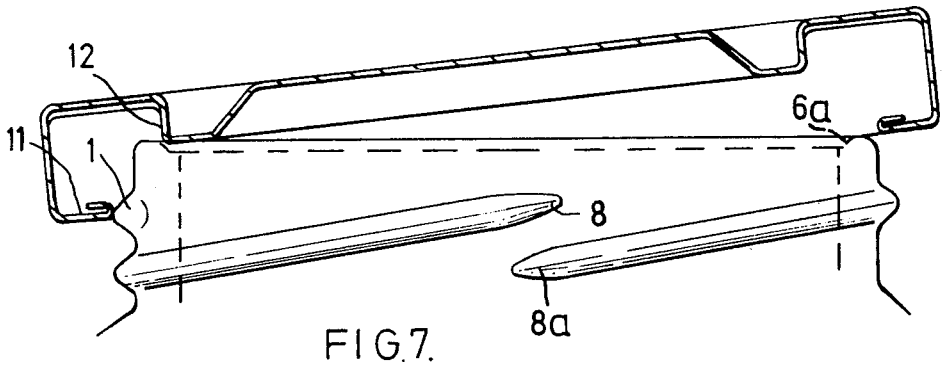
Figure 8:
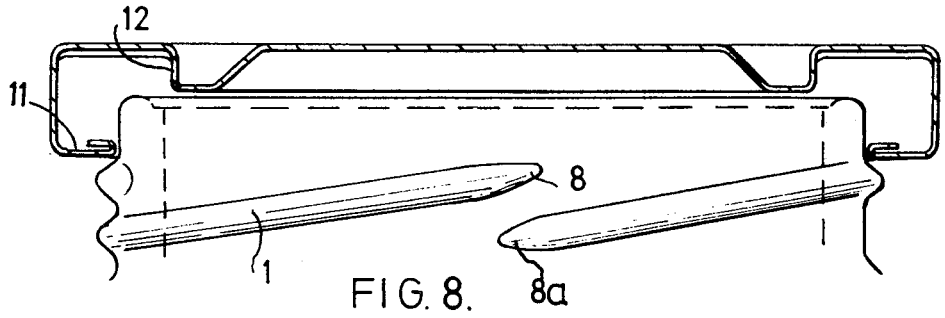

In cases where the lugs 11 are hooked below the thread 1, i.e. analogous with FIGS. 2 and 3, the position of FIG. 6 is reached wherein the lower end of the wall 12 in fact rests on the upper surface of the neck ring, since the dimension Y of FIG. 5 is less than the dimension X of FIG. 4 and the wall formation 12 cannot pass within the neck ring. At this stage of the engagement, the bottle, is still moving relative to the cap in a direction to the left of FIG. 6, and the cap is to some extent restrained from following in this movement, and therefore the cap tends to pivot about the bottom edge of the wall on the upper surface of the neck ring and this pivoting has a tendency to move the inner edge of the lug away from the thread. However, the continued movement of the jar keeps the thread in engagement with the lug as this lug rides or ride up the thread and the bottom edge of the wall rides inwardly along the upper surface of the neck ring. Eventually, the lug reaches or reach the top of the thread and is or are free to ride up the thread form so that the position of FIG. 7 and eventually FIG. 8 is reached. In the position shown in FIG. 7, the lug has reached the top of the thread form and the bottom edge of the wall 12 is now free to ride down the upper surface 6*a* of the neck ring. The opposite lug 11 is also free to pass over the top of the neck ring and avoid the engagement of it shown in FIG. 2. In the FIG. 8 position, the lugs 11 are all resting on the upper side of the thread form 1.

It will thus be seen that the provision of the wall 12 enables the hooking of the lugs beneath the threads to be automatically corrected by continued movement of the bottle, without damage to the lugs. This thus enables a considerable reduction in the failure rate of lug caps.

Figure 9:
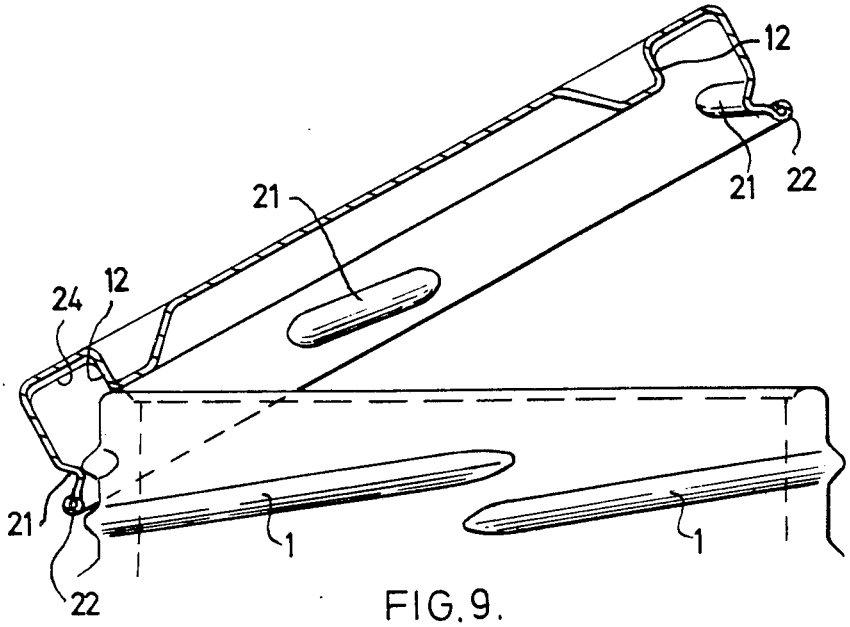
FIGS. 9, 10 and 11 are views similar to FIGS. 6 to 8, but showing how the invention can be applied to pre-threaded caps.
Figure 10:
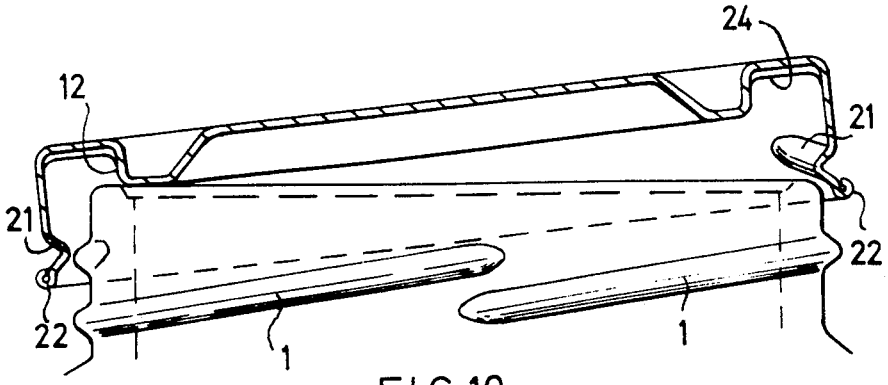
Figure 11:
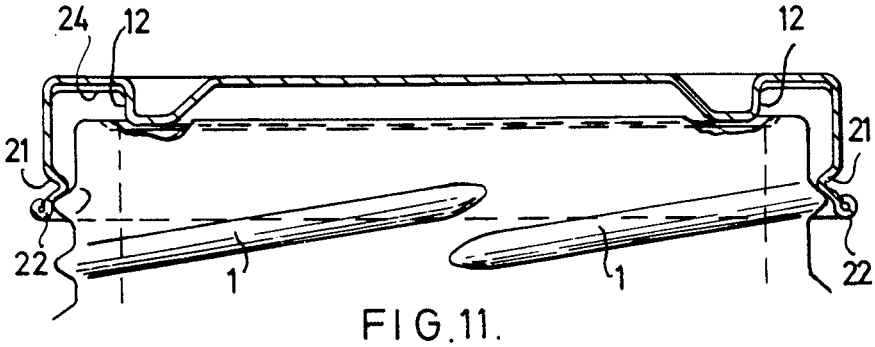

FIGS. 9, 10 and 11 show how the invention can also be applied to a pre-heated closure cap as opposed to the lug caps shown in FIGS. 4 to 8. The neck ring illustrated in these Figures is substantially identical to that shown in FIGS. 6 to 8, and it will be seen that instead of lugs, the cap has four short lengths 21 of internal thread which are engageable with the external thread forms 1 on the neck ring. The problems of non-self-correcting engagement or hooking are similar to those arising with lug caps, and are preventable in the same way by the provision of the wall 12 which, as illustrated in FIGS. 10 and 11 performs substantially the same function in this embodiment. The gap between the bottom of the wall 12 and the nearest point of the thread 21 must be not greater than the dimension X as illustrated in FIG. 4.

As is conventional, the pre-threaded caps have external bead 22 at the bottom end of the skirt in order to keep the internal diameter of the cap, and also the depth of impression of the thread form, to a minimum whilst providing the requisite rigidity to the open bottom end of the cap skirt.

Figure 12:
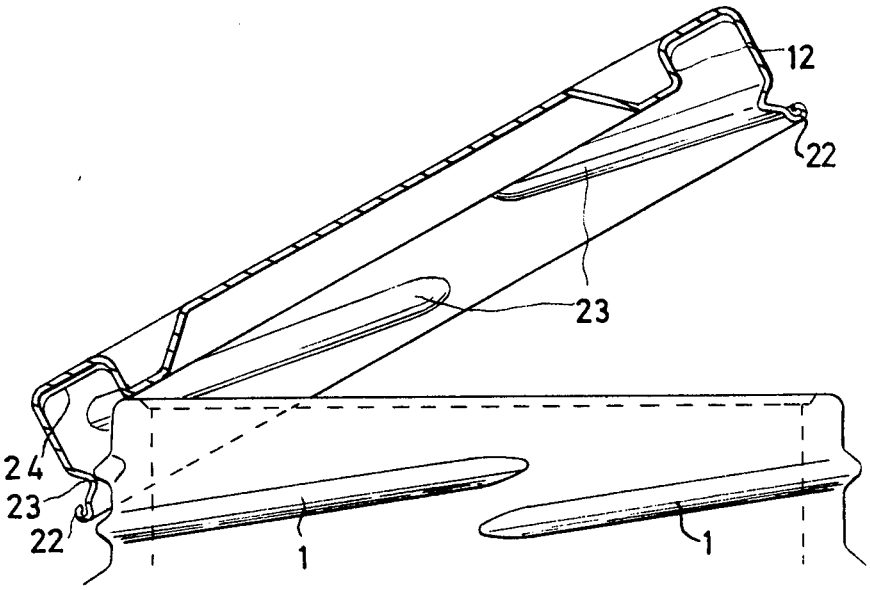
FIG. 12 is a view similar to FIG. 9 showing a modified form of closure cap.

FIG. 12 shows a variation of the pre-threaded closure cap of FIG. 9, in which the short lengths 21 of thread are replaced by somewhat longer lengths illustrated at 23.

In all the variations so far described, the wall 12 acts, in the regions of its root adjacent the top of the cap, as an inner boundary to the annular cavity containing the sealing compound which is indicated in FIGS. 9 and 12 by the reference numeral 24. This boundary is somewhat higher than in conventional caps of this type, and there is together with the surface tension in the compound as it is flowed into place, gives rise to the generation of a meniscus, which can be seen clearly in FIGS. 9 and 12, between the surface of the compound and the wall 12, so that there is an additional build-up of sealing compound in the zone in engagement with the inner surface of the neck ring when the cap is screwed down from the FIG. 8 and FIG. 11 position. This preferential build-up of material in this particular zone improves sealing and together with the cross sectional shape of the chute leads to some economy in the use of the sealing compound in comparison with conventional lug or pre-threaded caps.

In certain circumstances, it may be regarded as preferable for the wall 12 to be in sealing engagement with the inner surface of the neck ring as an alternative or additional mode of sealing and for this purpose it is also desirable that some sealing compound or other medium should be applied to the surface of the wall 12.

Figure 13:
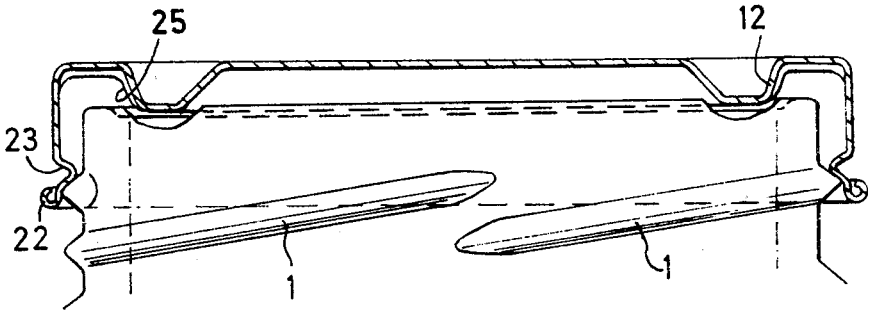
FIG. 13 is a view similar to FIG. 11 showing another type of modification of the cap.

FIG. 13 shows a further variation in which the wall 12 is not parallel with the skirt but is in fact somewhat tapered inwardly and downwardly from the top of the cap. This tapered version of the wall 12 is shown as being covered at 25 with sealing compound or other medium, and it will be appreciated that as the cap of FIG. 13 is screwed onto the neck ring, the tapered wall 12 and the sealing medium 25 thereon come into sealing engagement with the inner surface of the neck ring to give a so-called taper seal effect. The sealing medium on the inside of the top of the cap may be omitted.

It will be appreciated that this aspect of the invention may also be applied to lug caps as well as pre-threaded caps.

Various modifications may be made within the scope of the invention. Thus a conventional single start pre-threaded cap may be used.

We claim:

1. In the combination of a bottle, jar or the like having a neck with external threads, and a closure cap having a top and a depending skirt provided with preformed lugs or threads threadedly engaged with the said external threads on the neck so that an area of the top is engaged with the upper surface of the neck: the improvement that the top of the cap is provided, inwardly of the area engaged with the upper surface of the neck with a formation extending from the top in the same direction as the skirt to define a gap between the end of each lug or thread on the skirt and the nearest point of the formation, the said gap being sufficiently large for the formation to be able to enter the neck by pivoting about the lug or thread on the skirt when the lug or thread on the skirt is resting on the external thread on the neck but is insufficiently large to allow the formation to enter the neck whilst any of the lugs or threads on the skirt are firmly engaged beneath a thread on the neck.

2. A combination as claimed in claim 1 in which the upper surface of the neck has an inner corner and the gap is less than the minimum distance between the underside of the root of the thread and the inner corner of the neck.

3. A combination as claimed in claim 1, in which the formation is a circular wall extending substantially parallel with the skirt.

4. A combination as claimed in claim 3, in which the cap top reverts inwardly of the wall towards the level of the skirt top.

5. A combination as claimed in claim 3, in which the wall is provided with a sealing surface for engaging within the inside of the rim of the neck of the bottle, jar or the like.

6. A combination as claimed in claim 5, in which the sealing surface is provided by sealing compound flowed-in.

7. A combination as claimed in claim 1, in which the formation is a circular wall tapered inwardly from the top of the cap.

8. A combination as claimed in claim 7, in which the cap top reverts inwardly of the wall towards the level of the skirt top.

9. A combination as claimed in claim 7, in which the wall is provided with a sealing surface for engaging within the inside of the rim of the neck of the bottle, jar or the like.

10. A combination as claimed in claim 1, in which the formation is pressed into the cap.

11. A combination as claimed in claim 1, in which the closure cap is of aluminium.

12. A combination as claimed in claim 1, in which the closure cap is of tinplate.

* * * * *